United States Patent [19]

Selsted

[11] Patent Number: 4,461,704

[45] Date of Patent: Jul. 24, 1984

[54] POOL CLEANING DEVICE FOR OPERATION UNDER FLOATING POOL COVER

[75] Inventor: Walter T. Selsted, Cupertino, Calif.

[73] Assignee: Arneson Products, Inc., Corte Madera, Calif.

[21] Appl. No.: 319,562

[22] Filed: Nov. 9, 1981

[51] Int. Cl.[3] ..... E04H 3/20

[52] U.S. Cl. ..... 210/169; 210/416.2; 210/242.1; 15/4; 4/488; 134/16 R

[58] Field of Search ..... 210/169, 242.1, 416.2; 134/167 R, 167 C; 4/488, 508, 509; 15/4, 7; 261/77, 91

[56] References Cited

U.S. PATENT DOCUMENTS

| | | | |
|---|---|---|---|
| 3,184,764 | 5/1965 | West | 210/169 |
| 3,497,185 | 2/1970 | Dively | 261/91 |
| 3,669,422 | 6/1972 | Nogaj | 210/242.2 |
| 4,105,557 | 8/1978 | Weatherholt | 210/169 |

*Primary Examiner*—Peter A. Hruskoci
*Assistant Examiner*—Sharon T. Cohen

[57] ABSTRACT

A positive buoyancy programmed motion pool cleaning device is adapted for operation under a floating pool cover. The pool cleaning device is given positive buoyancy with floats fore and aft, both floats being adapted to provide positive buoyancy towards the pool cover while riding on an upper water bearing against the under surface of the pool cover. In this adaptation each float defines a concavity having a circumscribing annulus. At the interior of the concavity there is an outlet of a high volume, low pressure jet pump. Typically the high volume, low pressure jet pump includes a low volume, high pressure jet entraining and expanding water flow from beneath the floats through and elongate tube up, to, and discharging within the concavity. Preferably, the concavity and pump outlet are arranged with the pump outlet somewhat off center of the annulus walls so that pool cover plugging of the pump outlet does not occur. In operation, the concavity forms a water bearing pressure pocket. The pressure within this pocket is sufficient to provide positive fluid force lifting the cover. Reactive forces on the floating pool cleaning device place a force opposing the buoyant force on the pool cleaning device float. Travel of the float a sufficient distance under the cover results so that a fluid bearing exists between the float and cover at all times. The resultant fluid bearings provide a high lubricity interface permitting the programmed motion of pool cleaning device to continue without significant friction with the cover interrupting operation.

7 Claims, 2 Drawing Figures

POOL CLEANING DEVICE FOR OPERATION UNDER FLOATING POOL COVER

Figure 1:
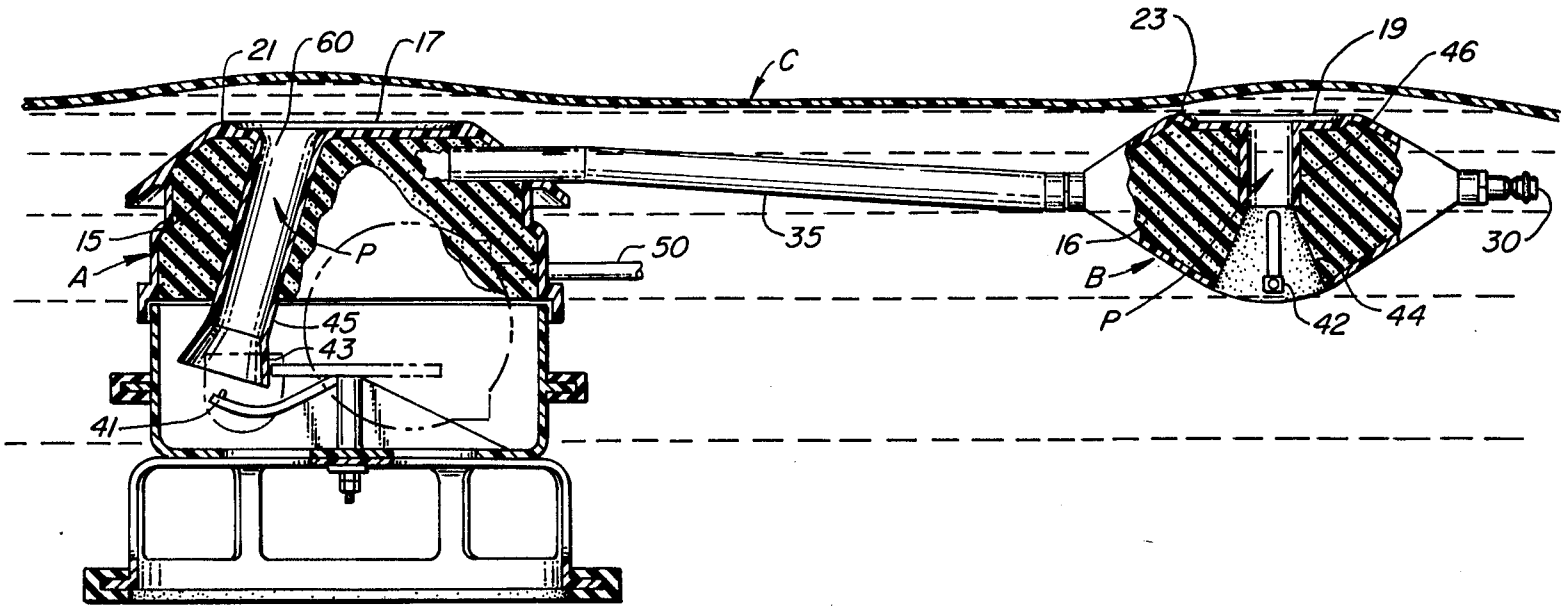

This invention relates to pool cleaning devices. More particularly a pool cleaning device for traveling under the floating cover of a pool is disclosed.

SUMMARY OF THE PRIOR ART

Floating pool cleaning devices having positive buoyancy are known. In one such device sold under the registered trademark "Pool Sweep", a trademark of the Arneson Products Corporation of Corte Madera, Ca., a floating device is given programmed motion to clean the pool. Such a device is illustrated in the patent application herein.

Specifically, the device is water powered. It includes a water supply powering the float at the rate of ten gallons per minute at a pressure on the order of thirty pounds. In operation and through various mechanical drives all now well known in the art, the pool sweep proceeds in the forward direction for a first and generally longer period of time—on the order of 4 minutes. Depending serpentine hoses with surface cleaning and abrading oblate spheroidal polishing elements depend downwardly from this floating device. During the moments of forward motion, the pool cleaning device moves to the pool sides. The depending hoses cause dirt to be swept from the sides and sidewalls of a swimming pool to and towards the center of a swimming pool. At the end of the forward cycle, a reverse jet power is applied to the pool cleaning device. The pool cleaning device moves in a backward motion to and towards the center of the pool. At this time the depending hoses sweep dirt to the center of the pool. The distrubance of dirt in the aggregate over many motions causes cleaning of the pool to and towards the pool drain.

It will be noticed that in such motion, pool sweeps are not precisely programmed as to their path. That is to say they are not confined on racks or railways to cover a particular path. Yet in sum their motion is programmed; by remaining along the pool sidewalls for first periods of time and moving to the center of the pool for other periods of time, a proven and systematic "programmed" cleaning results.

Of late, floating pool covers have not only proven useful but additionally are often times required. These pool covers perform several useful functions.

First, the pool cover provide thermal insulation. Typically swimming pools are heated. During cool hours of the day much heat energy can escape—the greatest loss occurring at the atmospheric interface of the pool. By placing a swimming pool cover on the surface, such losses can be retarded as the cover provides great resistance to heat flow.

Secondly, many covers are adapted to receive heat from the sun and transfer it to the surface of the pool. These covers have the difficulty in that on their lower surface at the pool water interface, heat transfers are relatively inefficient.

Finally, pool covers serve the purpose of keeping debris out of the pool in hours when the pool is not in use.

A disadvantage of such covers has been their tendency to grow and foster algae on their under surface. Since the water interface at the bottom of the cover is typically undisturbed for long periods of time, such locations provide ideal incubation and growth areas for algae.

The operation of pool cleaning devices under such covers has been attempted. In one prior art device, a submarine type device of programmed neutral buoyancy is utilized. Specifically, a neutrally buoyant cleaning device is jet powered in a path through the water. It contains therein a pressure sensing device. Typically the device is set so that the device remains submerged at a given depth, for example two feet. Where the device rises, decreased pressure is sensed, ballasting occurs and the sweep seeks the programmed level. When the device falls, increased pressure is sensed deballasting occurs and the device rises. Such pool cleaning devices have proved to be particularly sensitive to minor changes over the life of the device in the pressure sensing devices. Simply stated, while neutral buoyancy is easy to achieve in manned vehicles such as submarines, relying on numerous moving and sensing parts in the harsh chlorinated underwater environment of a pool over long periods of time has proven to be difficult.

SUMMARY OF THE INVENTION

A positive buoyancy programmed motion pool cleaning device is adapted for operation under a floating pool cover. The pool cleaning device is given positive buoyancy with floats fore and aft, both floats being adapted to provide positive buoyancy towards the pool cover while riding on an upper water bearing against the under surface of the pool cover. In this adaptation each float defines a concavity having a circumscribing annulus. At the interior of the concavity there is an outlet of a high volume, low pressure jet pump. Typically the high volume, low pressure jet pump includes a low volume, high pressure jet entraining and expanding water flow from beneath the floats through and elongate tube up, to, and discharging within the concavity. Preferably, the concavity and pump outlet are arranged with the pump outlet somewhat off center of the annulus walls so that pool cover plugging of the pump outlet does not occur. In operation, the concavity forms a water bearing pressure pocket. The pressure within this pocket is sufficient to provide positive fluid force lifting the cover. Reactive forces on the floating pool cleaning device place a force opposing the buoyant force on the pool cleaning device float. Travel of the float a sufficient distance under the cover results so that a fluid bearing exists between the float and cover at all times. The resultant fluid bearings provide a high lubricity interface permitting the programmed motion of pool cleaning device to continue without significant friction with the cover interrupting operation.

OTHER OBJECTS, FEATURES AND ADVANTAGES OF THE INVENTION

An object of this invention is to disclose in a positive buoyancy, programmed motion pool cleaning device a water bearing for undercover pool operation. According to this aspect of the invention, each of the floats of the device are provided with concavities. These respective concavities contain a circumscribing annulus and have in the medial portion thereof a high volume low pressure pump outlet. In operation, the concavity confronts the under surface of the floating pool cover. The positive buoyancy of the float urges the annulus up, to and towards the floating cover. At the same time the discharge of the high volume, low pressure pump forms a pressure area in the concavity bounded by the annulus. A floating fluid bearing results. The resultant fluid bearing has at its bounderies water cascading from the pocket to the pool.

An advantage of this invention is that a water bearing of high lubricity is provided. In conventional floating pool cleaning devices, the programmed yet random motion of such devices proceeds unimpaired.

A further advantage of this invention is that the produced water bearing has been found sufficient for the bottom of a number of pool covers, including those with corrugated under surfaces. Specifically, a popular type of pool cover includes a corrugated under surface. The fluid bearing of this invention relies on a programmed escape of water over the annulus to maintain the concavity the fluid pressure for the water bearing. The fluid bearing herein which relies on high volume, low pressure water pump has been found sufficient for use with even corrugated covers.

A further and unexpected byproduct of the positive buoyancy, water bearing submerged undercover pool cleaning device is that algae incubation and growth under the pool cover is systematically inhibited. While the sweeping device of this invention does not kill or retard completely such algae growth, inhibition of the growth is demonstrable.

A further advantage and synergistic effect of this device is found with solar blankets. In such blankets, the sweeping device systematically disturbs the pool cover, water surface interface. Heat transfer of received solar energy to the body of the submerged pool water is systematically encouraged. Simply stated, solar blanket efficiency is improved.

A further object of this invention is to provide the submerged under pool cover cleaning device with a hydraulically powered submerging mechanism with no moving parts. According to this aspect of the invention, each float is provided with a high volume, low pressure jet pump exhausting to the concavity. These jet pumps have an enlongated tube with a jet exhausting at the lower water entrance to the tube. Typically, water exhausts from the tube at the rate of eight gallons per minute at four inches water of static head. A high pressure, low volume jet (thirty pounds per square inch through one sixteenth inch diameter orifice) transfers its momentum in the tube to a low pressure, high volume water flow.

An advantage of this aspect of the invention is that the reactions of the water jet help maintain the low buoyancy level of the device so that travel under the cover of the pool is facilitated.

Yet another advantage of the disclosed jet pumps is their simplicity and complete lack of moving parts. Presuming that the filters used with the water power supplied such pool cleaning devices are used and maintained, virtually no possibility of pump failure is present.

A further object of this invention is to disclose a modification to existing pool cleaning devices which will be operable and workable whether or not the cover to the pool is on or off. According to this aspect of the invention, when the pool cover is off, the upper water bearing effect has been found to cause no deleterious effect on the pool cleaning device. Instead, the upward flow of water constitutes a disturbance of the pool surface. This disturbance is actually an aid in causing floating debris to sink to where it may be conventionally cleaned.

A further object of this invention is to disclose the relationship of the outlet of the high volume low pressure pump with respect to the circumscribing annulus in the outer bearing cavity. According to this aspect of the invention and most typically when the device is not operating, it is possible for the pool cover to sag on down and cover the outlet of the pump. If complete local covering of the pump outlet occurs, the weight of the pool cover is sufficient to prevent the pump from operating at all. In the disclosed device the expedient of locating the outlet off center of the annulus of the water bearing prevents pump plugging. Such sagging of the cover and consequent plugging of the outlet is avoided by causing the cover to span the pump exit under all cover conditions.

An advantage of the entirety of the apparatus herein disclosed is that many existing pool cleaning devices can be provided with kits which easily modify their operation for under pool covers.

Figure 2:
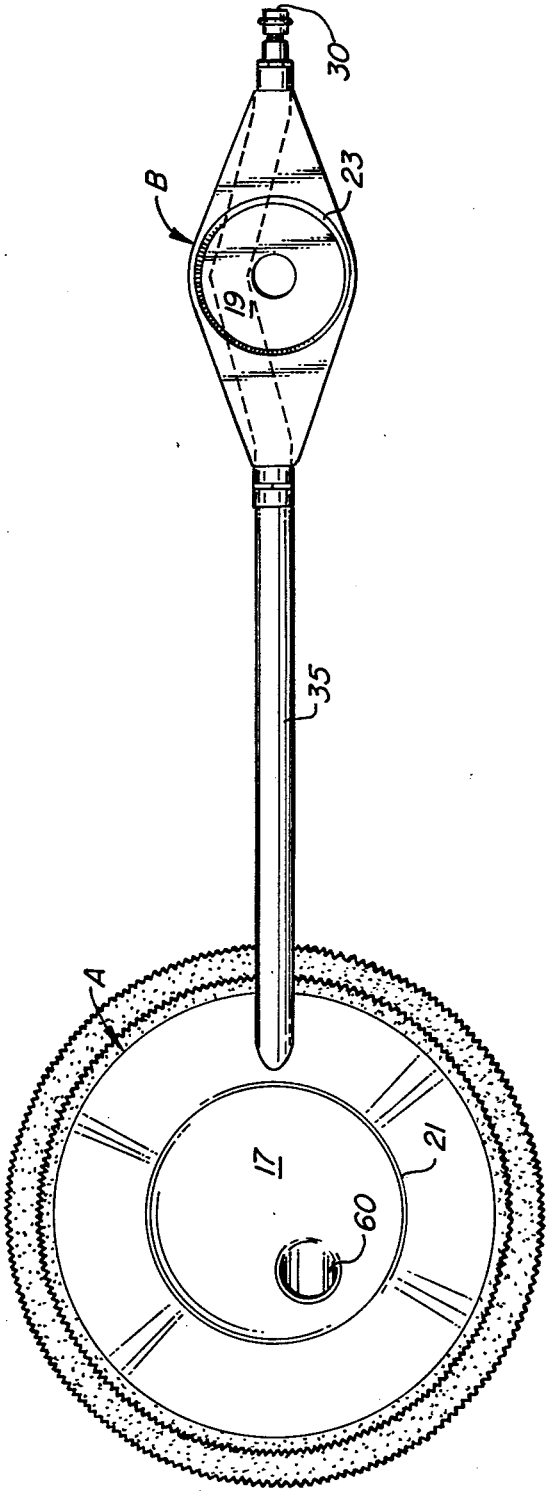

Other features and advantages of this invention will become more apparent after referring to the following specifications in which:

FIG. 1 is side elevation of a standard floating pool cleaning device previously described modified in accordance with the invention for under pool operation; and, FIG. 2 is a planned view from above the pool cleaning device.

Referring to FIGS. 1 and 2 a prior art floating pool cleaner is illustrated. Specifically, a cleaner having a mechanized float A and a stabilizer float B is shown. The respective floats are filled with buoyant material, this material generally being denoted 15 in the case of float A and 16 in the case of float B. This material may be selected from commercially available product and preferably is polyethelene foam. Its quantity is sufficient to provide positive buoyancy at each float in the range of one quarter to one half pound, this force bein emphirically determined dependent upon float design and cover materials.

Each float includes at the upper surface thereof a concavity. Concavity 17 is illustrated in the case of float A and concavity 19 in the case of float B.

The concavity generally cover an area of at least one half the area of the float and is surrounded by an annulus, this annulus being denoted 21 in the case of concavity 17 on float A and 23 in the case of concavity 19 on float B.

Each concavity includes a high volume low pressure jet pump P communicated thereto. These respective jet pumps introduce water into the concavities 17, 19.

Operation of the jet pump is easily understood. Each jet pump discharges to the respective concavity 17, 19 approximately eight gallons per minute at the static head of approximately four inches of water. Such a flow rate has been found sufficient for the lifting of the pool cover and the desired reactive force to submerge the pump. Pool cleaning units such as the one illustrated in FIGS. 1 and 2 are powered by a ten gallon per minute water flow provided at a pressure of approximately thirty pounds per square inch. Typically such water flow is provided by a booster pump communicating to a swimming pool filter outflow, the booster pump discharging from the filter through screens to prevent intermittent debris from clogging machine workings. Fluid power supply comes to the sweeping unit through a manifold inlet 30 by way of a floating hose. A manifold 35 runs throughout the sweeping unit discharging water at various points for unit propulsion.

In particular and as is relevant to the disclosure herein two manifold discharges are added. The first of these manifold discharges is a jet 41 at the bottom of pump P in float A. Jet 41 discharges to a frustoconical inlet 43 and vents to a momentum transfer tube 45 which forms the momentum transfer stream for the high pressure, low volume jet discharge.

Tube 45 is selected to be of a length to permit the desired jet pump momentum transfer to occur. Typically the outflow at thirty pounds per square inch from a one sixteenth inch diameter hole at jet 41 transfers to the eight gallon per minute four inches of water static head flow to the concavity 17. Tube size is typically one and a quarter inch in diameter and approximate four inches in length.

Pump P in float B is constructed and operates substantially identically. Specifically, jet 42 outflows into a frustoconical aperture 44 and vents to tube 46 with discharge interior of the concavity 19.

In each pump the size and shape of the discharge to the frustroconical apertures of the pump P and the length of the respective tubes are made sufficiently long so that momentum transfer from a one sixteenth of an inch nozzle at thirty pounds per square inch produces the desired eight gallons per minute, four inches of water static head within the concavity 19.

Regarding the dimensions of the concavities, it will be noticed that they have been given an area at least equal to an order of about one half the area of the total float. This gives the fluid bearings a stable area over which they may bear on the underside of the pool covers. Tipping or tilting of the annulus 21 in the case of float A and annulus 23 in the case of float B into contact with the pool cover is avoided. Simply stated the area of the annulus gives the fluid bearing a sufficiently large footing on the under surface of the pool cover so that tipping of the unit into contact with the pool cover is avoided.

It should be noted that in case of both of the floats, the respective concavities 17, 19 must occupy a flattened portion. The remainder of the floats are conventionally shaped. In the case of float B such shaping must take into account two separate factors.

First, it has been found that jet 42 must have a sufficient distance for discharge through the frustoconical aperture 44 to tube 46 before exhausting into concavity 19. If sufficient distance is not provided, the cover will see only the low volume, high pressure flow of the jet and not the high volume low pressure flow needed to raise the pool cover. The designed fluid bearing will not work and instead undesirable side effects will occur. These effects included localized high pressure streams of water on the pool cover which are insufficient to raise it above the float and the entrainment of air by the jet 42 from the surface of the pool.

Secondly, float B must be shaped so that it does not represent a substantial interference to the programmed motion of the sweeping device through the water. In such programmed motion, a jet 50 on float A exhausts water to and towards the rear float B. If float B is dimensioned to constitute a substantial obstruction to the water from jet 50, a reactive force develops on the sweeping unit. Propulsion of the unit through the water is retarded.

Operation of the device may be readily understood. Specifically, and assuming that the pool cover is in place and no motive fluid power applied to manifold inlet 30, the cover will be in direct contact with the sweeping unit. With fluid supplied to manifold inlet 30, the respective jets 41 and 42 will emit water to their respective concavities 17, 19.

In the case of float A, it will be noted that the outlet 60 is eccentrically located with respect to the annulus 21. This eccentric location prevents the pool cover C from sagging downwardly to and on top of the discharge aperture 60 of the pump and preventing the discharge of water. Rather, the proximity of the outlet 60 to the annulus 21 prevents the pool cover from directly covering the discharge of pump P. When it is remembered that during rain storms and the like, it is common for pool covers to accumulate puddles of water, it will be understood that the eccentric location of the pump discharge P can be important for the commencement of operation under all conditions at all cover locations.

Once the jets 41, 42 discharge their high pressure low volume jets, momentum transfers in each of pumps P occur. There is discharged to the concavities 17, 19 a flow of water at rate of eight gallons per minute with four inches of water of static head.

The water under pressure fills the entire volumes of each of the concavities 17, 19. This pressure in effect provides a fluid bearing and high pressure area which locally raises the pool cover C over each of the floats. At the same time there is a reactive downward pressure on each of the floats A, B. This reactive and downward pressure produces a hydrostatic balance wherein the float is free to move under the cover on a fluid bearing.

Discharge of water from the concavity 17, 19 of the fluid bearing occurs over the respective annuluses 21, 23. This cascading discharge allows for a rate controlled discharge of water from the fluid bearing and prevents any part of the float from coming in actual physical contact with the pool cover C during the motion permitted by the respective bearings. Simply stated, with the respective fluid bearings of the concavities 17, 19 in operation, movement of the floating pool cleaning device under the cover C occurs substantially the same whether or not the cover C is present.

Where the cover C is removed, no alternation or adjustment of the pool cleaning device need occur. Instead, the pumps P are merely allowed to discharge, producing at the pool surface interruption to the ambient surface tensions present. Floating objects such as leaves, pine needles and the like are randomly disturbed as the floating cleaning unit moves over to the surface of the pool. There results a systematic sinking and thereafter cleaning of such objects from the pool.

As an additional benefit of the disclosed invention, we have found that the escape of water over the respective annuluses 21, 23 has retarded the growth of algae. At the same time, and in the case of certain solar pool blankets, circulation of heated water throughout the pool occurs. Heat transfer is inhenced and the heating effect of the solar blanket may be efficient.

It will be noticed that there exists a small taper in the order of twenty-five degrees around the edge of the floats. These tapers have proved useful in cleaning obstructions, especially where the cover is folded as disposed across the surface of the pool.

What is claimed:

1. In a floating pool cleaning apparatus having positive buoyancy and propelled motion adjacent to the surface of a swimming pool, an apparatus for permitting such motion under a floating pool cover, comprising:

a float having a concavity defined at a top portion of said apparatus disposed to confront said pool cover;

an annulus surrounding said defined concavity; and a high volume low pressure jet pump comprising a tube, said tube at one end communicating to said concavity and at an opposite end having a low volume, high pressure jet port discharging thereto, said pump discharging to the volume of said concavity to cause a flow of water from said pump to the volume of said concavity, over said annulus, and between said cover and said pump.

2. The invention of claim 1, and wherein said jet pump includes an outlet inside of and off-center from said annulus.

3. In a swimming pool cleaning device, the combination of a floating pool cleaning vehicle for movement on a swimming pool surface, a flow of power and water for said vehicle supplied at high pressure and low volume, and a floating pool cover disposed on said pool surface and over said vehicle, the improvement in said pool cleaning device comprising:

the combination with said floating pool cleaning vehicle including a float with an upper surface defining an upwardly disposed concavity, said concavity having a high volume, low pressure jet pump discharging into the interior thereof and being circumscribed by an annulus, said jet pump comprises a tube, said tube at one end communicating to said concavity and at an opposite end having a low volume, high pressure jet port discharging thereto; and means for powering said pump to discharge water into the concavity and to cause water to escape between the annulus and said pool cover, whereby a water bearing of high lubricity is formed for permitting movement of said vehicle under said pool cover.

4. The invention of claim 3 and wherein said discharge of said jet pump is off center with respect to said concavity.

5. The invention of claim 4, and wherein said floating pool cleaning vehicle includes first and second floats, each of said floats defining a separate concavity having a high volume, low pressure jet pump discharging thereunto and each of said floats being circumscribed by an annulus.

6. In combination with a swimming pool apparatus for maintaining the pool and including a floating pool cover, a floating pool cleaning apparatus having positive buoyancy and propelled motion adjacent to the surface of said swimming pool beneath said pool cover, comprising:

a float having a concavity defined at a top portion of said floating pool cleaning apparatus between said pool cover and said apparatus, said concavity disposed to confront said pool cover;

an annulus surrounding said defined concavity; and a high volume low pressure jet pump discharging a flow of water to the volume of said concavity which overflows said annulus to define between said pool cover and said pool cleaning apparatus a fluid bearing of high lubricity, said jet pump includes a tube, said tube at one end communicating to said concavity and at an opposite end having a low volume high pressure jet port discharging thereto.

7. The invention of claim 6 wherein a bottom surface of said pool cover is corrugated and wherein said jet pump is a high volume, low pressure pump.

* * * * *